US006135624A

United States Patent [19]

Masters et al.

[11] Patent Number: 6,135,624

[45] Date of Patent: Oct. 24, 2000

[54] UNIVERSAL MOUNTING PLATE FOR LUMINAIRE FIXTURE

[75] Inventors: Andrew Edward Masters, Berlin, Md.; James Michael Lay, Cumming, Ga.

[73] Assignee: NSI Enterprises, Inc., Atlanta, Ga.

[21] Appl. No.: 09/298,305

[22] Filed: Apr. 23, 1999

[51] Int. Cl.[7] ..... F21S 13/02

[52] U.S. Cl. ..... 362/432; 362/145; 362/368; 362/388; 362/457

[58] Field of Search ..... 362/145, 147, 362/249, 368, 370, 388, 432, 457; 248/205.1, 207, 214, 218, 219.1, 220.21, 220.22, 220.31, 223.31

[56] References Cited

U.S. PATENT DOCUMENTS

| | | | |
|---|---|---|---|
| 3,919,459 | 11/1975 | Van Steenhoven | 174/63 |
| 4,972,301 | 11/1990 | Kasboske | 362/549 |
| 5,272,605 | 12/1993 | Johnstone | 362/147 |
| 5,526,251 | 6/1996 | Andre et al. | 362/396 |

*Primary Examiner*—Sandra O'Shea
*Assistant Examiner*—Ismael Negron
*Attorney, Agent, or Firm*—Kenneth E. Darnell

[57] ABSTRACT

A mounting plate capable of mounting emergency unit fixtures or similar fixtures in an industrial environment, the mounting plate of the invention being securely attachable to a variety of support structures including horizontal and vertical wall surfaces, posts of differing cross-sectional shapes and dimensions and Unistrut components. The mounting plate is formed generally as a flat body having integral portions formed out of plane to provide particular mounting functions. The unit fixtures per se mount directly to the mounting plate through engagement of openings formed on rear walls of the unit fixtures with free legs of bayonet mounts extending from a face of the mounting plate, the plate being snap-locked in certain embodiments to the fixtures, a locking mechanism being actuated on full engagement of the bayonet mounts to positively hold the unit fixtures to the mounting plate. The mounting plate can be attached to wall surfaces by means of screws after use of nailing stakes utilized for temporary holding the mounting plate to a wall. Banding or strapping elements can be used with the mounting plate to attach the mounting plate/unit fixture combination to poles of varying shape and thickness, thereby particularly allowing mounting to round and square columns and the like.

17 Claims, 11 Drawing Sheets

Fig. 6
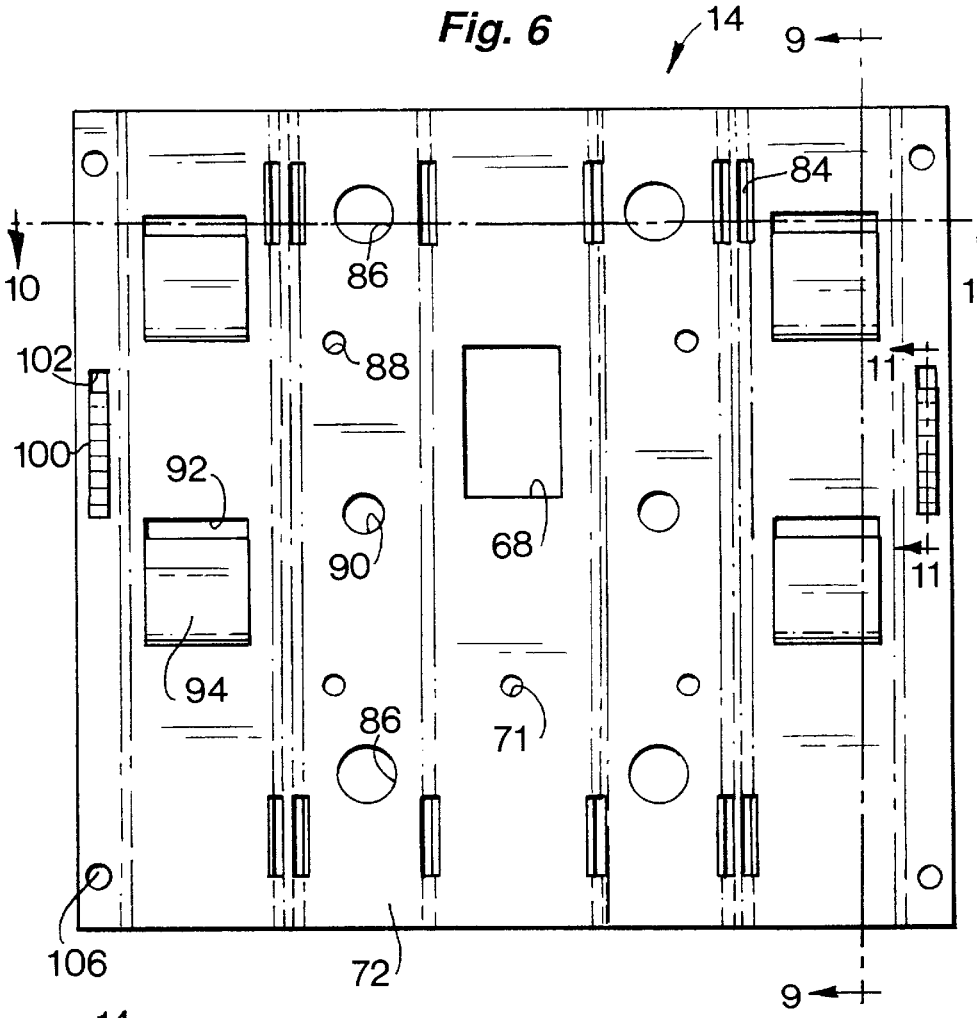
Fig. 7
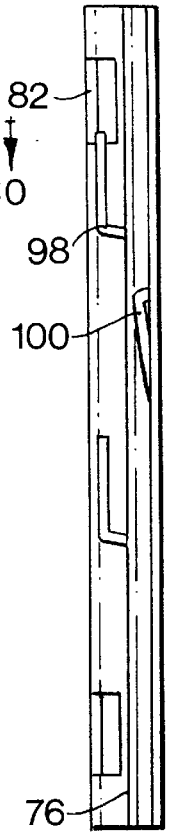
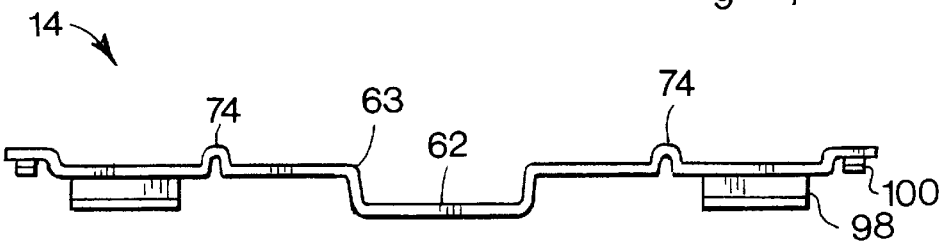
Fig. 8

UNIVERSAL MOUNTING PLATE FOR LUMINAIRE FIXTURE

BACKGROUND OF THE INVENTION

1. Field of the Invention

The invention relates generally to universal mounting plates and particularly to a universal mounting plate intended for mounting industrial emergency unit fixtures to a variety of substrates and support structures.

2. Description of the Prior Art

Luminaire fixtures intended for use in industrial environments take a variety of configurations which provide illumination of desirable efficiency and photometric distributions. These fixtures must be mounted in a manner which provides for positive and essentially permanent placement of the fixtures in desired locations of the industrial environment. Industrial emergency unit fixtures, as well as other fixtures, must be mounted in the industrial environment at particular locations as normally required by code in order to meet specific safety requirements. Since such fixtures must be mounted at particular locations within the industrial environment, it is essential that the fixtures be mountable to whatever structure is available at the necessary mounting locations. While it is often possible to mount an emergency unit fixture directly to a wall or to a ceiling, it is necessary to be able to mount such fixtures to poles, piping, columns, concrete beams and even metal framing systems, such as Unistrut frameworks, Unistrut being a trademark of the Unistrut Corporation of Houston, Tex. Such mounting must be positive and essentially permanent for reasons of safety and further must be amenable to rapid installation without requirement for modification of the fixture or of the structure to which the fixture is to be mounted. Industrial fixtures and particularly emergency fixtures which typically carry batteries internally of a fixture housing can be of substantial weight and therefore must be securely mounted at heights above the floor of an industrial environment so that the fixtures can perform intended functions such as providing illumination during emergency conditions, power outages and the like. Such heavy fixtures mounted above a floor of an environmental space must be positively held at mounting locations in order to prevent accidental dislodgment of such fixtures from mounting locations to thereby cause an extreme safety hazard.

While luminaire fixtures per se and particularly industrial emergency unit fixtures cannot be designed to enable direct mounting to walls, poles, columns and the like through direct use of fixture housings per se, it is possible to facilitate mounting of such fixtures by use of apparatus having so-called universal mounting application, such mounting apparatus having mounting holes formed therein which meet standards of the National Electric Code. In U.S. Pat. No. 4,460,948, Malola describes an adjustable mounting plate which assists in supporting and balancing a luminaire fixture in a desired orientation, the mounting plate being capable of connection to a variety of luminaire housings and a variety of supporting structure existing in an industrial environment. However, the prior art does not provide a mounting plate structure which can be rapidly mounted to virtually any structure existing in an industrial environment and wherein a luminaire fixture, particularly an industrial emergency unit fixture, can then be rapidly and positively connected to the mounting plate in order to provide positive, safe and reliable mounting of such fixtures at or in virtually any location within the industrial environment. Further, the mounting device of the invention can be mounted to poles both round and square in section, I-beams, structural columns and the like as well as flat walls and even to UNISTRUT mounting apparatus of known configuration, the fixture itself then being directly mounted to the invention in a manner which is rapidly installable while assuring safety. Mounting of a fixture to the mounting device of the invention is accomplished by the provision of relatively simple structure on the fixtures per se for engagement of the fixtures to the mounting device of the invention, thereby allowing mounting of luminaire fixtures as aforesaid within an industrial environment in a manner which is safe, reliable and flexible as to location due to the variety of structure to which the invention allows mounting of luminaire fixtures.

SUMMARY OF THE INVENTION

The present invention provides a universal mounting device particularly intended for the mounting of industrial emergency unit fixtures to essentially any available structure in an industrial environment. The universal mounting device essentially takes the form of a "plate" which can be mounted to structure within an industrial environment of varying description, an industrial emergency unit fixture or other luminaire fixture then being mountable to the mounting plate of the invention by means of a simple slide-on connection mechanism which can be coupled with a snap-lock mechanism for more effective securement of the fixture in place. The mounting plate of the invention is particularly useful for the mounting of emergency unit fixtures since such features must be located at particular places within the industrial environment and it is desirable to be able to mount such emergency fixtures to any structure available at such locations without the expense associated with providing dedicated structure simply for the purpose of mounting a fixture.

The universal mounting plate of the invention allows mounting of industrial emergency unit fixtures as well as other luminaire fixtures in an environment and particularly an industrial environment both rapidly and efficiently and with security of mounting so as to render the mounting safe for occupants of the environment. The mounting plate allows direct mounting to a surface such as a wall surface whether horizontally or vertically oriented, the mounting plate having a temporary attachment mechanism in the form of nailing stakes which preliminarily mount the plate to a suitable substrate prior to the attachment of the plate to said substrate with screws or similar connectors. The mounting plate of the invention is further provided with slots located in favorable relation to shaped portions of the plate so as to allow mounting of the plate to poles of both round and square cross-section and of varying diameter. Steel banding or the like is utilized in association with the mounting plate to fix said plate to said poles or the like prior to connection of a fixture to the plate. The mounting plate of the invention can further be mounted to I-beams and to structural columns of varying cross-section and size by the same expedient. Still further, the mounting plate of the invention can be provided with apertures located for mounting to metal framing systems, such as Unistrut or similar frameworks, Unistrut being a registered trademark of the Unistrut Corporation, Houston, Tex.

On mounting of the mounting plate of the invention to structure within an industrial environment, an industrial fixture having spaced openings formed in a housing thereof is slipped over bayonet-like projections formed in the mounting plate. A snap-lock mechanism can further be provided with a portion of the mechanism being formed integrally with the mounting plate of the invention and with the other portion of the snap-lock mechanism being formed in the housing of the luminaire fixture so that the fixture is locked in place on engagement of the bayonet structure of the mounting plate with corresponding openings of the luminaire housing.

The mounting plate of the invention further provides openings which facilitate mounting of J-box structures as well as the pass-through of wiring associated therewith. The mounting plate thus permits access of necessary electrical wiring or the like to a luminaire fixture mounted thereto. The mounting plate further provides flexibility in design of an environmental space by virtue of the ability of the mounting plate to cooperate with a wide variety of commonly available structures in an environmental space within which luminaire fixtures and particularly emergency unit fixtures must be mounted at particular locations within the environmental space, it thus being possible to minimize planning and construction of dedicated structure to which such luminaire fixtures are to be mounted.

The lighting fixtures mounted by the present mounting plate are positively retained on the plate, normal vibrations and even seismic activity being incapable of causing separation between the fixtures and the plate which is firmly connected to structure within the industrial environment. Mounting of the plate to environmental structure further leaves both hands free for connection of the fixture to the mounting plate. Use of the nailer shown herein allows the plate to be attachable without impediments to the hands to further connection of the plate to wall structure and the like.

Accordingly, it is a primary object of the invention to provide a universal mounting device capable of being rapidly, positively and securely mounted to a variety of common structure available in an industrial environmental space, the mounting device being capable of rapidly and positively receiving a luminaire fixture such as an industrial emergency unit fixture onto said device for secure mounting of said fixture.

It is another object of the invention to provide a mounting plate having formed integrally therewith a variety of openings, projections and the like which facilitate mounting of the plate to structure within an environmental space and further the mounting of a luminaire fixture to the mounting plate itself.

It is a further object of the invention to provide a mounting plate capable of mounting to structure as varied as flat walls, poles, I-beams and structural columns and further being temporarily stakeable to a flat wall surface prior to the use of screws or other connectors for more permanent mounting, the mounting plate on connection to an environmental structure then allowing the rapid and positive securement of luminaire fixtures and the like to said mounting plate.

Further objects and advantages of the invention will become more readily apparent in light of the following detailed description of the preferred embodiments.

BRIEF DESCRIPTION OF THE DRAWINGS

FIG. 6 is a front elevational view of the mounting plate of FIG. 5;

FIG. 7 is a side elevational view of the mounting plate of FIG. 6;

FIG. 8 is a front elevational view of the mounting plate of FIG. 6;

DESCRIPTION OF THE PREFERRED EMBODIMENTS

Figure 1:
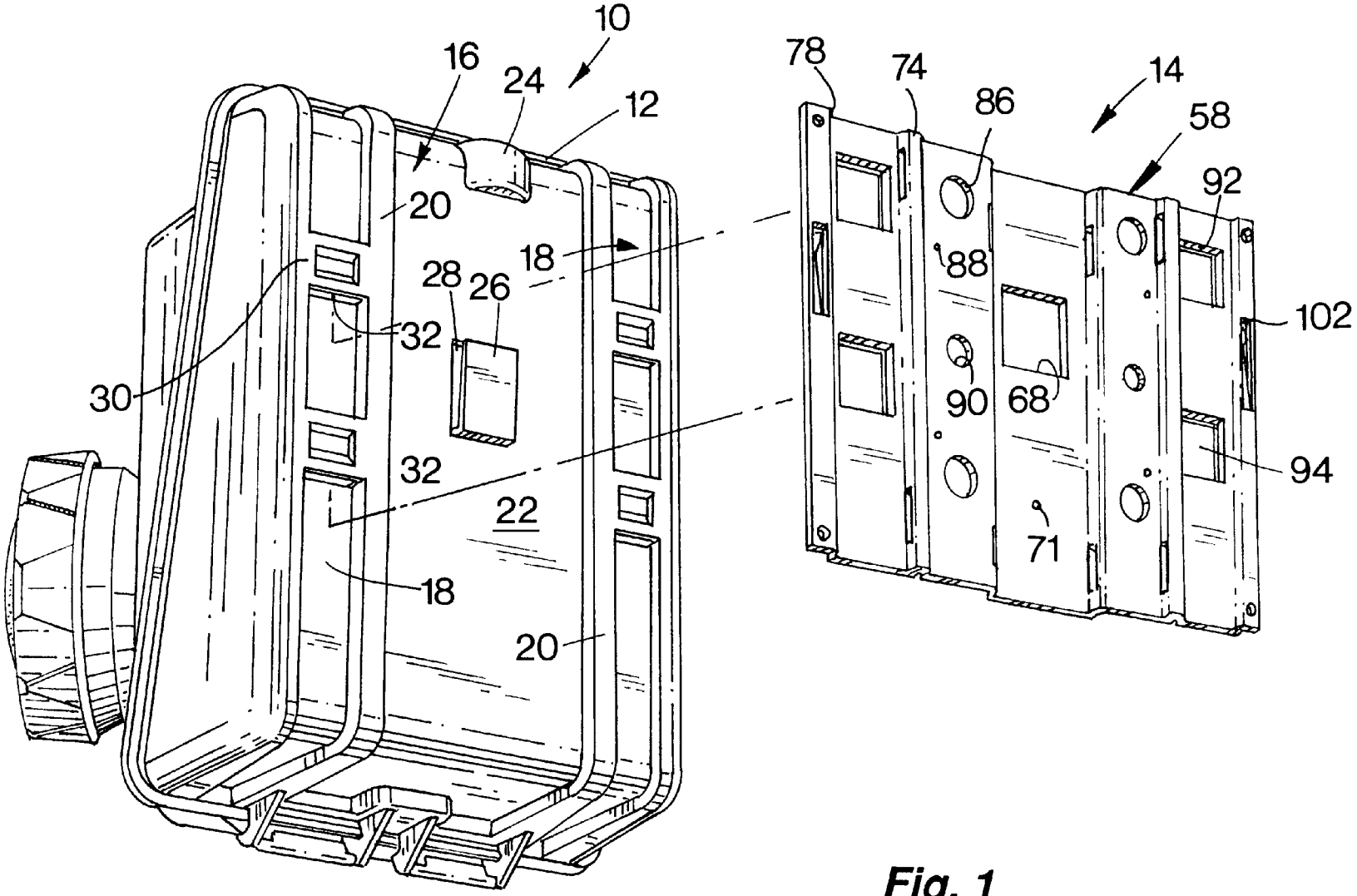
FIG. 1 is an exploded perspective view illustrating an emergency unit fixture arranged in assembly relation to a universal mounting plate of the invention.

Referring now to the drawings and particularly to FIG. 1, a lighting fixture mountable according to the present invention is seen generally at 10 to comprise an industrial emergency unit fixture, the fixture 10 being mountable at particular locations according to code and according to safety considerations at particular locations within an industrial environment so that emergency lighting is provided under emergency conditions including failure of mains electrical power. Emergency unit fixtures such as the fixture 10 are almost always mounted at a height within an industrial space which is greater than eye level. Due to the expense of mounting emergency fixtures such as the fixture 10 to structure other than that structure which incidentally occurs at intended mounting locations, it is desirable that the fixture 10 be mountable to virtually any kind of available structure including wall structure, poles of varying dimension and cross-sectional shape, structural columns of varying size and cross-sectional shape, I-beams, UNISTRUT frameworks, etc. The ability to mount fixtures such as the fixture 10 to virtually any structure available in the environmental space minimizes the necessity for providing special structure to which the fixture 10 can be mounted, thereby minimizing costs and reducing the need for special planning for fixture mounting capability.

In order to most effectively utilize a universal mounting plate configured according to the invention a portion of a housing 12 of the fixture 10 is configured to be rapidly and simply mountable to the fixture 10. The universal mounting plate of the invention is seen in FIG. 1 in exploded relation to the fixture 10 and is also seen in FIGS. 2 through 11, the plate being generally referred to as the mounting plate 14. While the housing 12 of the fixture 10 can be formed of a variety of materials, it is particularly convenient to form the housing 12 of a polymeric material, that is, a material such as is conventionally referred to as a "plastic" material, for a variety of reasons. In particular, a "plastic" material can be formed in the manner of rear face 16 to integrally include structure which engages and cooperates with the mounting plate 14 to mount said fixture 10. In particular channels 18 are defined on either side of the fixture 10 by integral, elevated ribs 20 which are substantially rectangular in cross-section. The ribs not only define the channels 18 but also impart additional strength to the housing 12. A major planar surface 22 is formed centrally of the rear face 16 of the housing 12 between the elevated ribs 20. An upper portion of the planar surface 22 has a collar 24 formed therein intended to receive a conduit (not shown) which can carry electrical wiring (not shown) into the interior of the fixture 10. A resilient rectangular tab 26 is formed congruently with and is movable within a rectangular opening 28 formed essentially centrally in the planar surface 22, the tab 26 extending slightly outwardly of the surface 22 to engage cooperating structure on the mounting plate 14 to snap-lock the plate 14 to the fixture 10 as will be described further hereinafter.

The channels 18 on the rear face 16 of the fixture 10 are interrupted by pairs of cross elements 30 which are integrally formed with the ribs 20 and which have slots 32 formed in lower side edges of each lowermost cross element 30, the slots 32 communicating with portions of the channels 18 which are dimensioned to receive structure of the plate 14 as will be described hereinafter.

Figure 2:
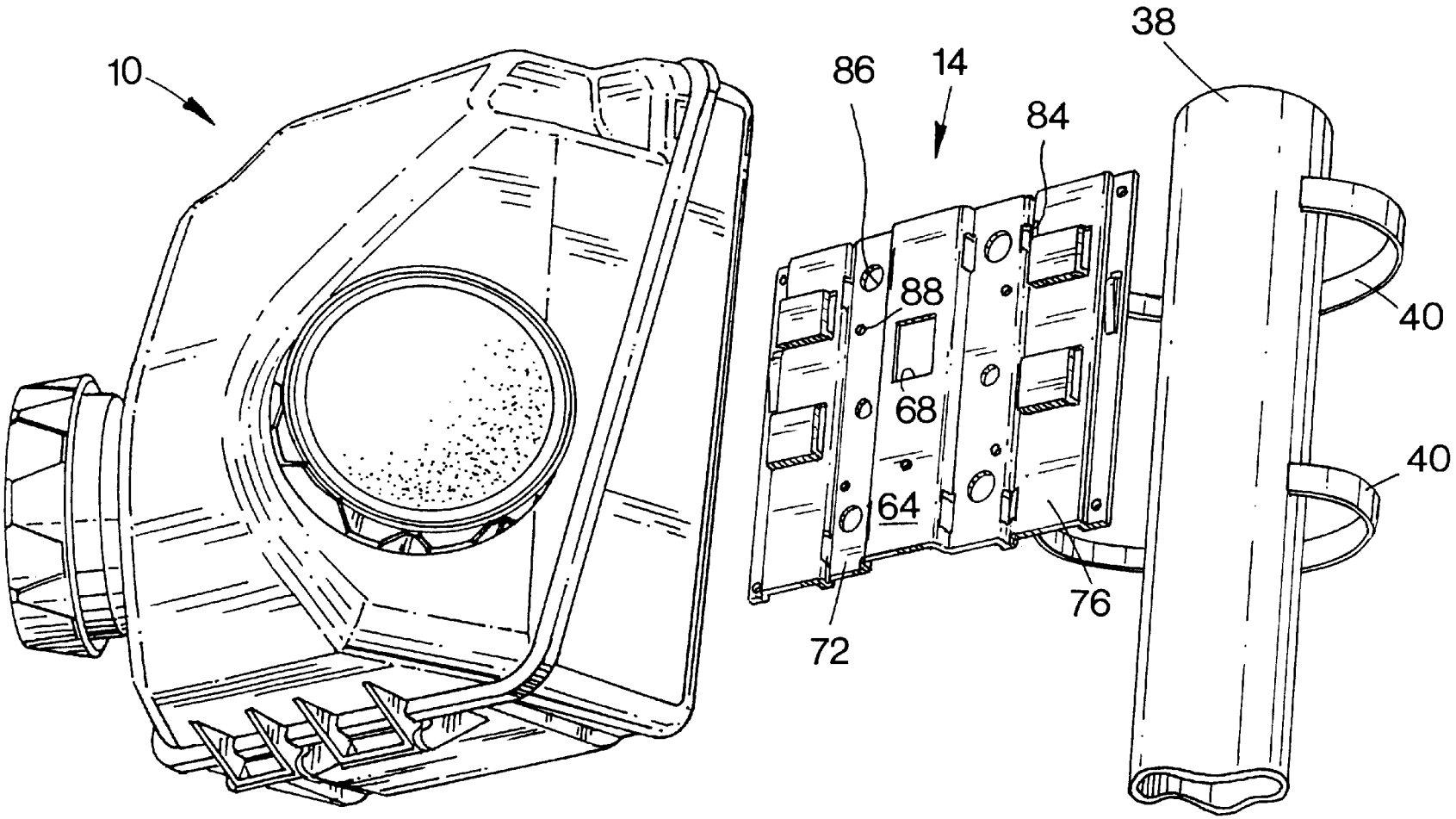
FIG. 2 is an exploded view of an industrial emergency unit fixture as is shown in FIG. 1 with the mounting plate of the invention in assembly relationship thereto and as seen from the other side of the assembly and in relationship to a pole to which the mounting plate is to be strapped.

Referring now to FIG. 2, an exploded view is seen with the mounting plate 14 being disposed in relationship to the rear of the fixture 10 and to a pole 38 shown to the rear of the mounting plate 14. Strapping or banding 40, such as steel banding or fabric banding, is seen to be wrapped around the pole 38 and pulled through banding slots as can best be seen in FIG. 5 inter alia. Tool-banding methods as well as other banding or strapping techniques can be used. The slots have rounded edges to relieve any stresses on the banding. The mounting plate 14 is thus seen to be mounted to the pole 38 prior to mounting of the fixture 10 to the mounting plate 14. In essentially all mounting situations envisioned according to the invention, the mounting plate 14 is first mounted to structure within an environmental space, the mounting of the relatively small and light-weight mounting plate being extremely easy, the heavier fixture 10 not being dealt with in an assembly situation until the mounting plate 14 has been securely mounted to structure such as the pole 38 of FIG. 2. Banding or strapping is also utilized for mounting of the mounting plate 12 to structural columns of varying dimension and cross-sectional shape as well as to structural I-beams and the like.

Figure 3:
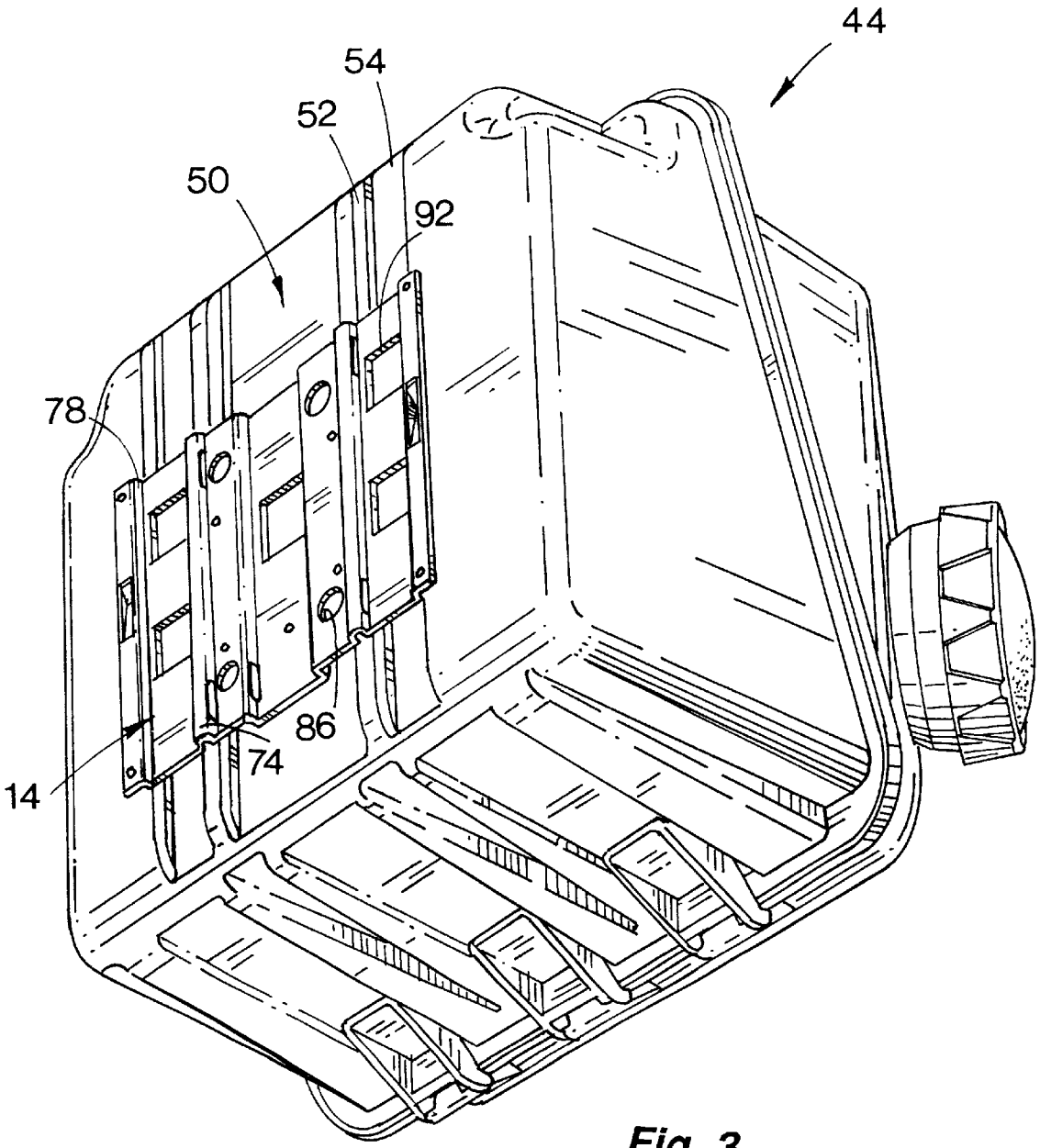
FIG. 3 is a perspective view of another industrial emergency unit fixture as seen from the rear thereof and having a universal mounting plate formed according to the invention shown in an assembled relation thereto, the assembly being shown in an exploded relation to an I-beam to which the plate is mounted preferably prior to attachment to the fixture.
Figure 4:
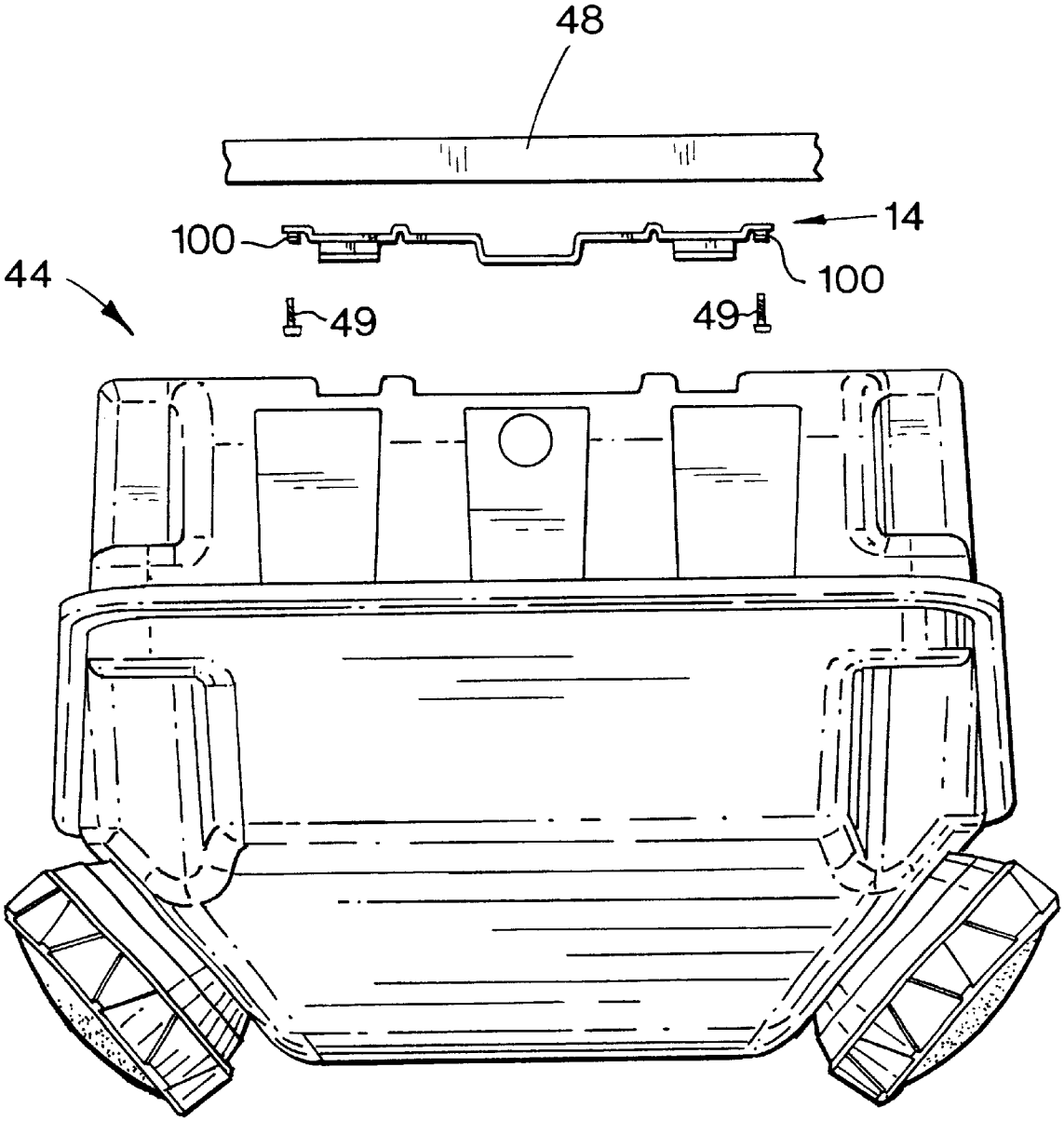
FIG. 4 is a top view of the assembly of FIG. 3 shown in relation to a wall to which the plate is first connected prior to assembly of the fixture to the plate.
Figure 5:
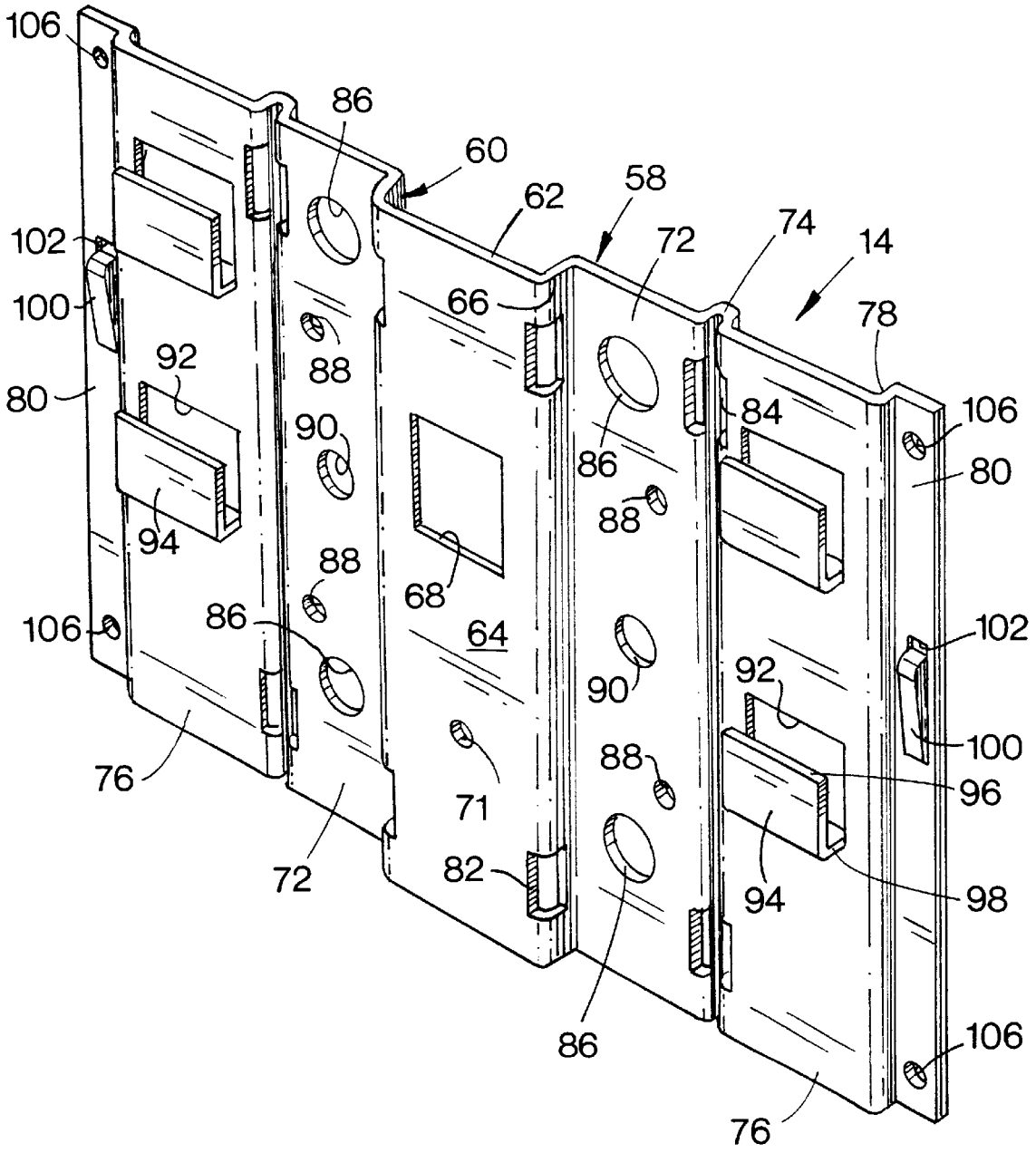
FIG. 5 is a perspective view of a preferred embodiment of the present universal mounting plate.

Referring to FIG. 3, it is to be seen that the mounting plate 14 is usable with industrial emergency unit fixtures of differing size, fixture 44 of FIGS. 3 and 4 being of a greater size than the fixture 10 of FIGS. 1 and 2. The mounting plate 14 is disposed against a rear face of the fixture 44 in a location as would exist after mounting of the plate 14 to an I-beam (not shown), for example, or relative to a wall 48 as seen in FIG. 4. Except in unusual circumstances, the mounting plate 14 will be mounted to an I-beam or the like or the wall 48 prior to attachment of the fixture 44 to the mounting plate 14. The rear face 50 of the fixture 44 can be seen to be configured similarly to the rear face 16 of the fixture 10 in that ribs 52 define channels 54 having slots (not shown) which function in the manner of the slots 32 as described relative to the fixture 10. It is to be understood that the mounting plate 14 as seen in FIGS. 3 and 4 would not typically be mounted to the fixture 44 prior to secure attachment of the mounting plate 14 to structure within an environmental space although it is possible to do so. In the assembly of FIG. 4. screws 49 or other fasteners allow permanent mounting to a wall 48 through appropriate apertures formed in the plate 14.

Referring now generally to the drawings and particularly to FIGS. 5 through 11, particular structure of the mounting plate 14 can be seen and appreciated. The mounting plate 14 is seen to comprise a substantially rectangular body 58 having a central channel 60 defined by a U-shaped central body portion 62 having a substantially flattened yoke portion 64 with slightly angled leg portions 66 terminating said body portion 62. The yoke portion 64 has an opening 68 formed therein, said opening 68 receiving the tab 26 formed on the housing 12 of the fixture 10 thereinto on attachment of the fixture 10 to the mounting plate 14, the tab 26 being bent out of plane within the opening 28 of the housing 12, the tab 26 then snap-locking into the opening 68. As is seen in FIG. 1, the tab 26 is provided with a tab element 70 formed normal to the tab 26 and extending inwardly of the housing 12 to strengthen said tab 26 and to facilitate manual unlocking of the locking mechanism provided by the tab 26 and the opening 68. The snap-locking mechanism thus described is only used when a material forming the housing 12 is sufficiently flexible to allow the flexure required for sufficient movement to provide snap-locking. It is to be seen that the larger fixture 44 is not provided with a tab and opening as is found in the housing 12 of the fixture 10. The larger fixture 44 is provided with a threaded aperture (not shown) on the rear face thereof for receipt of a threaded fastener such as a screw (not shown) which is received within a threaded opening 71 formed in the yoke portion 64 of the body portion 62, thereby to allow fastening of the mounting plate 14 to the fixture 44.

The angled leg portions 66 of the central body portion 62 each recurve outwardly to form lateral planar body potions 72 on each side of the U-shaped central body portion 62, the planes within which the lateral planar body portions lie being coincidental with each other and parallel to the plane of the yoke portion 64 of the central body portion 62. The lateral planar body portions 72 have openings formed therein as will be described hereinafter. The lateral planar body portions 72 each curve out of plane along outer lateral edges thereof to form a U-shaped rib 74 at each location, the ribs 74 each recurving outwardly to form outer planar body portions 76 with one each of the body portions 76 being formed outwardly of each of the body portions 72. The planes within which the body portions 76 lie are coincidental with each other and further are coincidental with the plane within which the body portions 72 lie. Along lateral edges of each of the outer planar body portions 76, the mounting plate 14 curves inwardly to form a lateral leg 78 at each end of the mounting plate 14, the lateral legs each recurving outwardly to form lateral end flanges 80 which effectively complete the body structure of the mounting plate 14. The mounting plate 14, along with various integrally formed structure stamped from the plate 14 and which will be discussed hereinafter, is preferably formed of cold-rolled steel of a thickness of approximately 0.1046 inch, that is, 12 gauge stock, the plate 14 then being powder coated for additional rust resistance. The mounting plate 14 is thereby seen to be rapidly and inexpensively manufactured using common manufacturing techniques and equipment.

Figure 11:
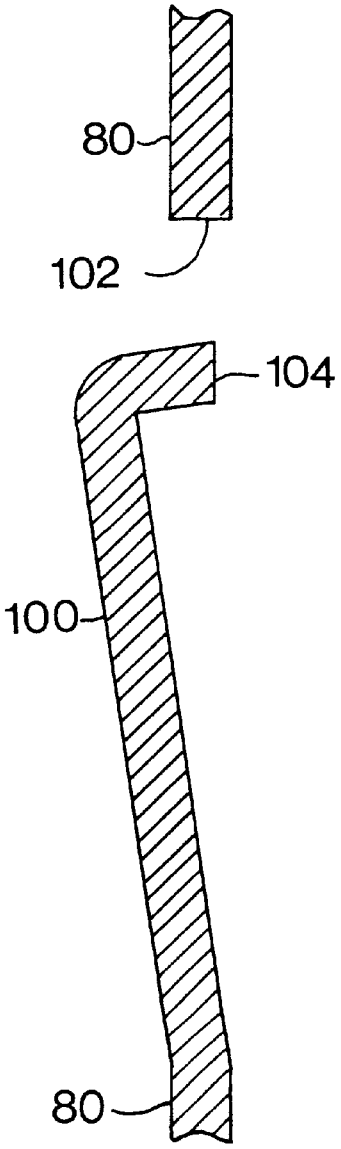
FIG. 11 is a detail sectional view taken along line 11—11 of FIG. 6.
Figure 10:
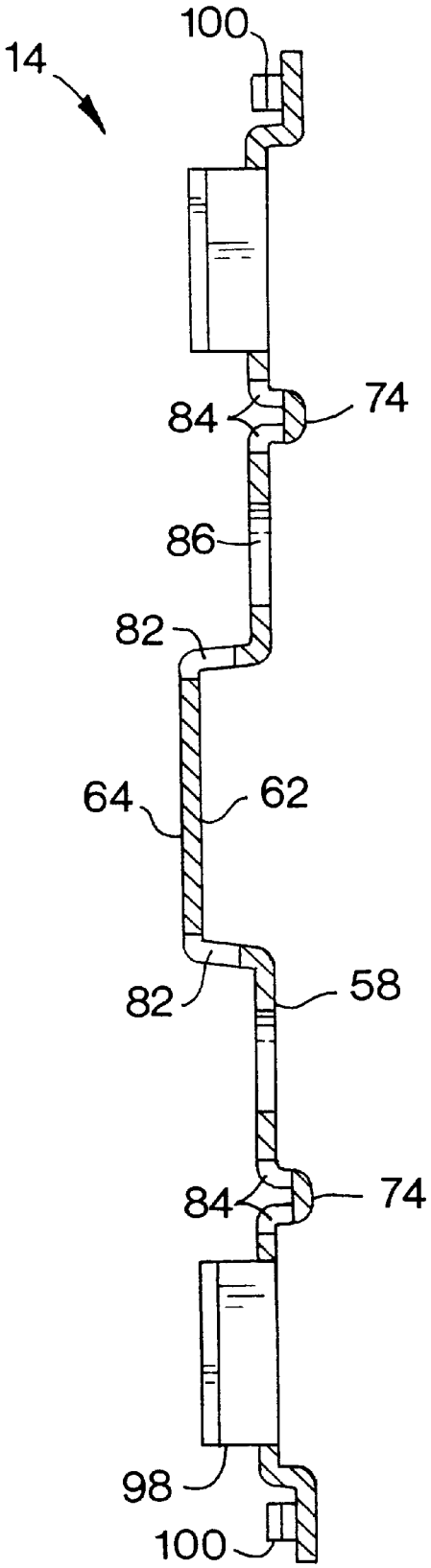
FIG. 10 is a sectional view taken along line 10—10 of FIG. 6.
Figure 9:
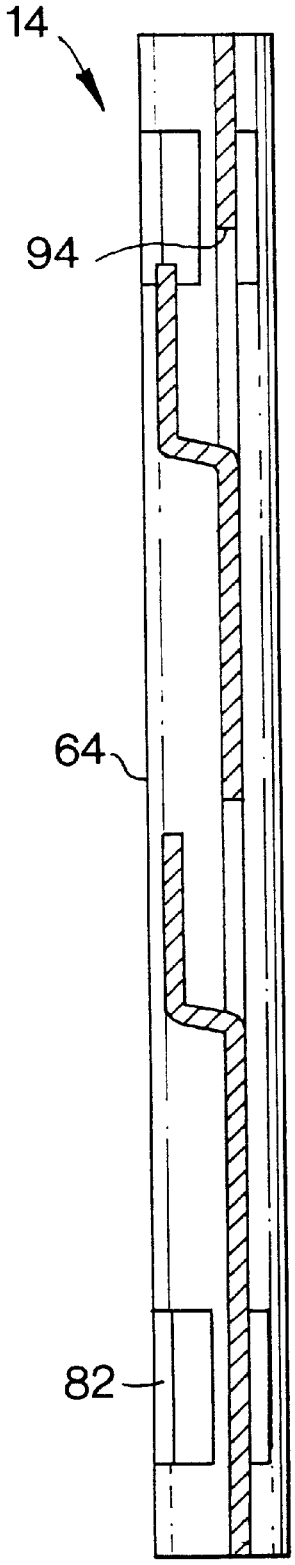
FIG. 9 is a sectional view taken along line 9—9 of FIG. 6.
Figure 12:
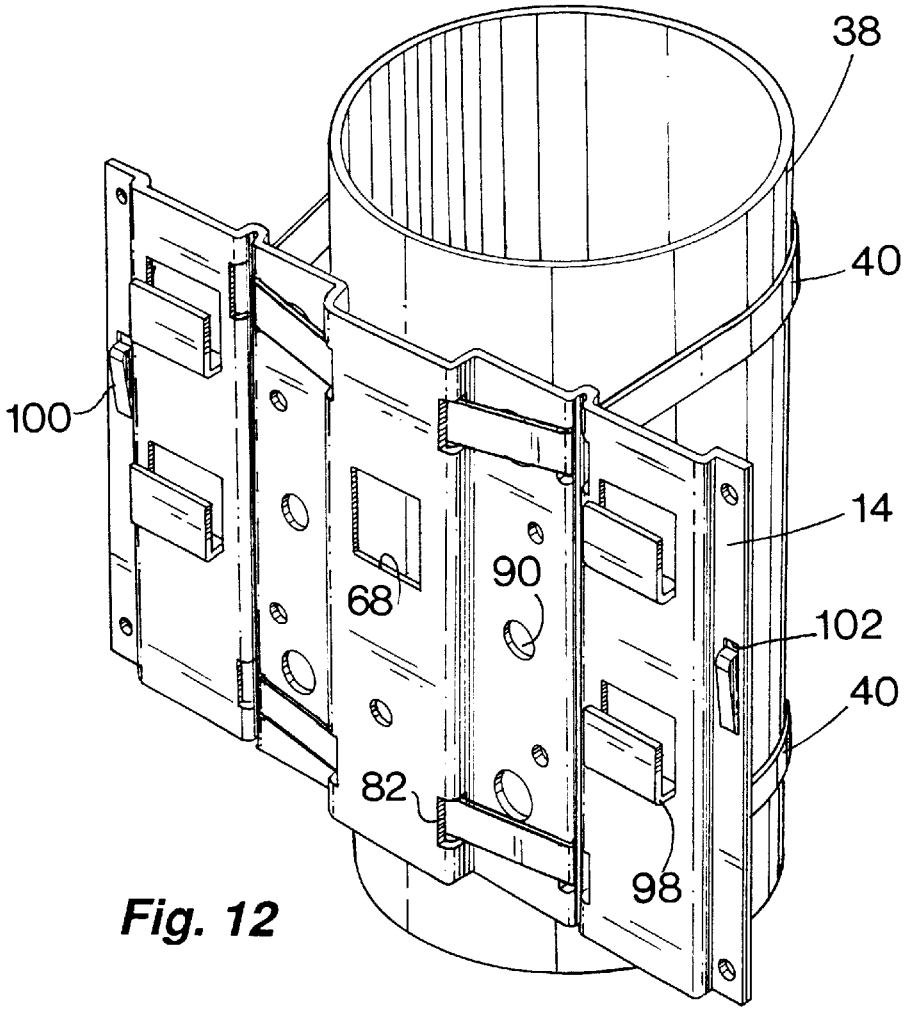
FIG. 12 is a perspective view illustrating attachment of the mounting plate of the invention to a pole by means of strapping.
Figure 13:
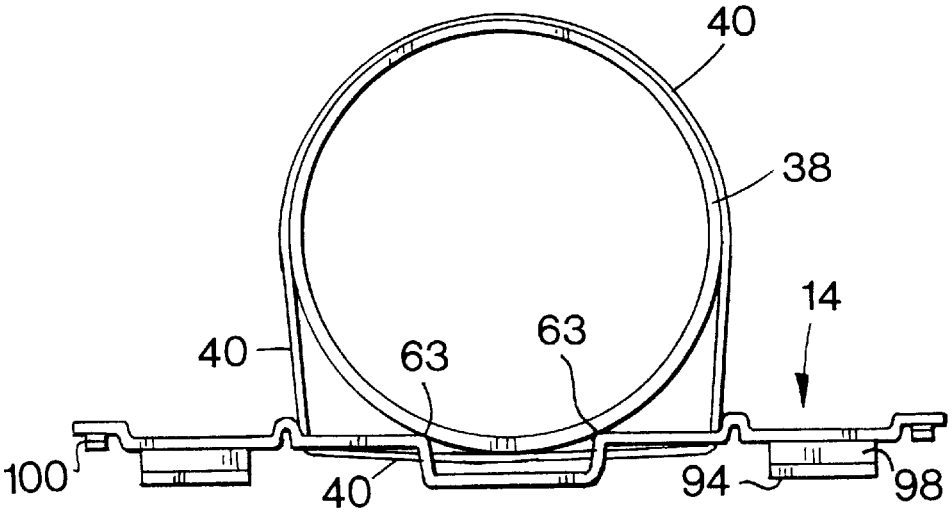
FIG. 13 is a top view taken from above the assembly of FIG. 12 illustrating contact between portions of the mounting plate and the pole to which said plate is attached.

Referring again to FIGS. 5 through 11 inter alia, the U-shaped central body portion 62 at the juncture of the yoke portion 64 and each of the angled leg portions 66 is formed with four slots 82 with a pair of the slots being formed at one end of the body portion 62 and the other pair of the slots being formed at the opposite end thereof. These slots 82 are particularly useful for receiving strapping or banding therethrough to connect the mounting plate 14 with a pole such as the pole 38 as seen in FIG. 2, banding also being seen in FIG. 2 as shown at 40. In the event that the pole 38 is of a fairly standard diameter of 4 inches, the central body portion 62 essentially engages the pole 38 on attachment of the mounting plate 14 thereto by means of the banding 40 since the width of the body portion 62 is essentially 4 inches in dimension. The plate 14 is seen in FIGS. 12 and 13 to be mounted to the pole 38 prior to attachment of a lighting fixture thereto, lines of contact between the pole 38 and corners 63 of the plate 14 being seen in FIG. 14 due to a prearranged distance between the corners 63.

Slots 84 are formed in oppositely facing pairs at upper and lower portions of the U-shaped ribs 74 to facilitate the use of banding such as the banding 40 or other strapping such as steel strapping for attachment of the mounting plate 14 to structures such as I-beams, for example, or to concrete posts, columns, etc.

The lateral planar body portions 72 have a series of substantially circular apertures formed therein with two pairs of relatively large diameter apertures 86 formed in upper and lower portions of the lateral planar body portions 72, these apertures 86 being intended to receive a bolt portion of a UNISTRUT framework or the like. A UNISTRUT framework is a common mounting structure utilizing a spring nut and bolt fitted into a continuously slotted channel, this structure being a product of the Unistrut Corportion of Houston, Tex., with Unistrut being a registered trademark of that corporation. In such a mounting arrangement, a bolt (not shown) would be received into the apertures 86 and then into a threaded nut which is spring mounted within a slotted channel (not shown), the bolt, nut, spring and slotted channel being known in the art as a Unistrut mounting arrangement.

Threaded apertures 88 formed in a substantially square pattern in the lateral planar body portions 72 are intended to facilitate mounting of a J-box (not shown) by means of threaded connectors such as screws (not shown) in the event that a J-box structure is necessary for mounting to the mounting plate 14. Apertures 90 formed in the lateral planar body portions 72 between pairs of the apertures 88 are provided for the pass-through of wiring (not shown) from a J-box when utilized.

Each of the outer planar body portions 76 are provided with pairs of openings 92 with two each of the openings 92 being formed in each of the outer planar body portions 76. The openings 92 are essentially arranged in a rectangular conformation with each of the openings 92 being essentially located at a corner of a rectangular pattern so formed. Punched from each opening 92 is a bayonet bracket 94 which preferably is formed in a manner, such as by a punching operation as aforesaid, which causes the brackets 94 to be formed integrally with the remaining portions of the mounting plate 14. Each of the bayonet brackets 94 is effectively L-shaped in section with free ends 96 extending upwardly. Once the mounting plate 14 is caused to be connected to structure within an environmental space, such as a pole, wall or the like, a fixture, such as the fixture 10 or the fixture 44, is brought into engagement with the mounting plate 14 such that the bayonet brackets 94 are received into a portion of the channels 18 with the fixture 10 or 44 being then moved downwardly relative to the mounting plate so that the free ends 96 of the bayonet brackets 94 enter the slots 32 formed in the cross-elements 30 of the fixture housings as described above. Leg portions of the bayonet brackets 94 then extend through the slots 32 and into the interior of the fixture housings until structural portions of the housings defining the slots 32 engage base portions 98 respectively of each of the bayonet brackets 94. The fixtures 10 and 44 are thus mounted to the mounting plate 14 through cooperation of structure formed on rear faces of said fixture housings and structure, particularly the bayonet brackets 94, of the mounting plate 14.

When mounting the mounting plate 14 to a wall such as the wall 48 of FIG. 4, temporary nailing stakes 100 punched from openings 102 formed respectively in each of the lateral end flanges 80 can be used. The nailing stakes 100 are also seen in FIG. 11 to be punched from material forming the lateral end flanges 80, free ends 104 of each of the nailing stakes 100 being bent over to form a spike-like element which is slightly sharpened in order to facilitate nailing of the stakes 100 into a wall. In an installation situation whereby the mounting plate 14 is to be mounted to a wall, the nailing stakes 100 can be quickly and easily struck with a hammer or the like to temporarily mount the plate 14 to the wall such as the wall 48 of FIG. 3, the free ends 104 of the stakes 100 penetrating the wall to provide this temporary mounting. Screws or similar fasteners can then be utilized as aforesaid to mount the plate 14 to the wall through apertures 106 formed at respective ends of the flanges 80 essentially at the corners of the mounting plate 14. The apertures 106 are not visible in FIG. 4.

Figure 14:
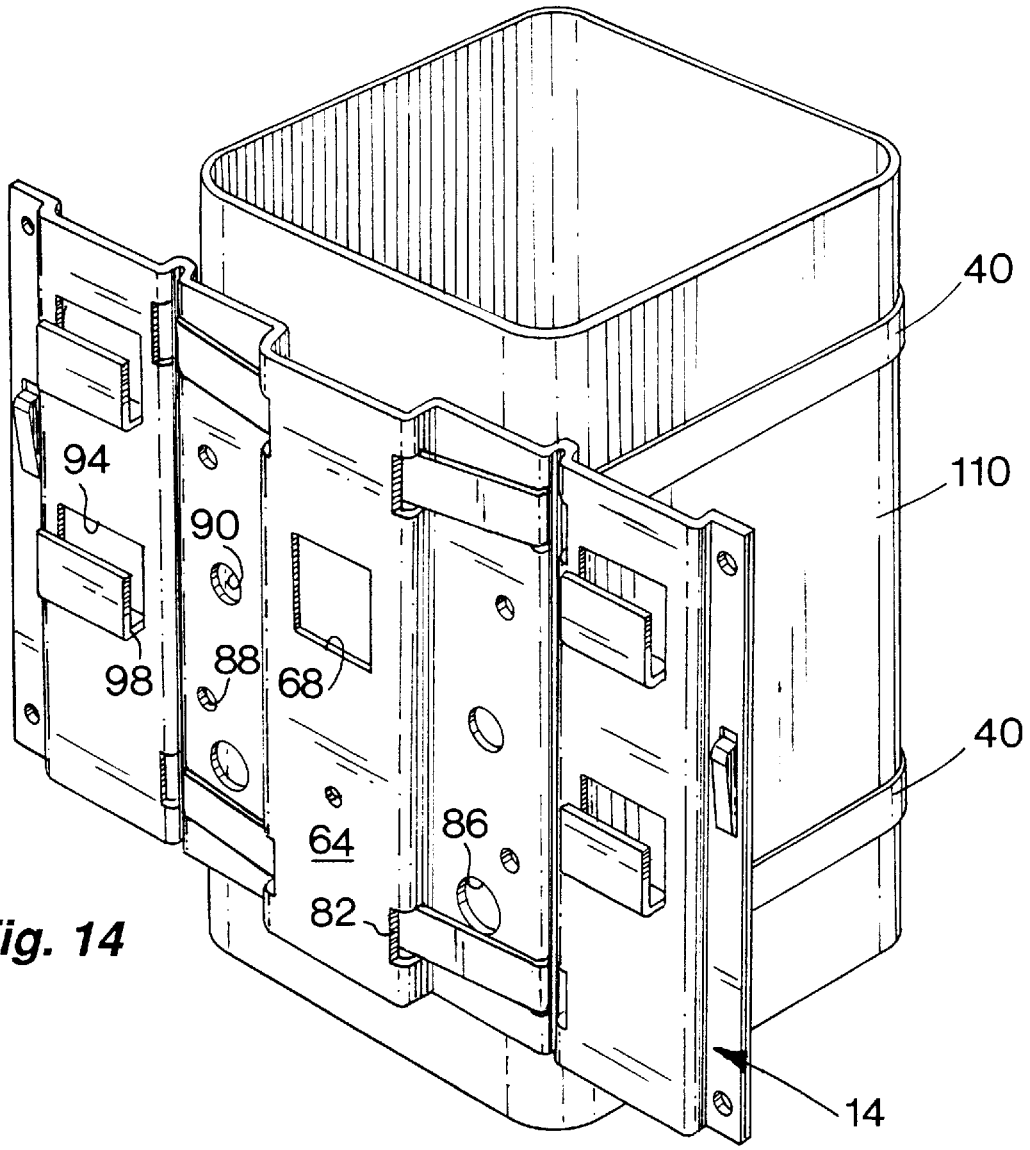
FIG. 14 is a perspective view illustrating the attachment of the mounting plate of the invention to a square post by means of strapping.
Figure 15:
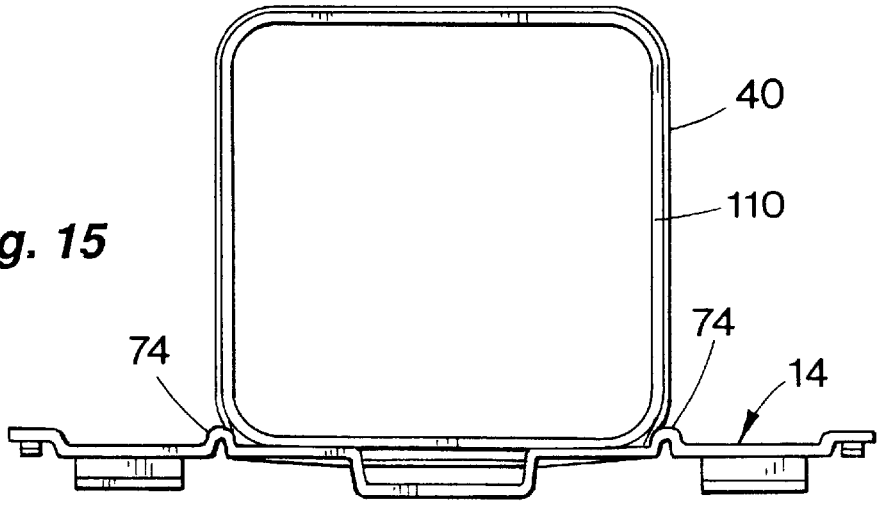
FIG. 15 is a top view taken from above the assembly of FIG. 14 illustrating contact between planar portions of the mounting plate and planar portions of one side of the square post.

FIGS. 14 and 15 particularly illustrate connection of the mounting plate 14 to a square post or tube 110 by means of strapping 40. As is best seen in FIG. 15, the distance between corners of the ribs 74 of the plate 14 allows stabilizing contact between planar surfaces of the plate 14 lying between the ribs 74 and a flat portion of the square post 110. The square post 110 is therefore "locked in" to prevent side-to-side movement of the mounting plate 14 relative to the square post 110.

Figure 16:
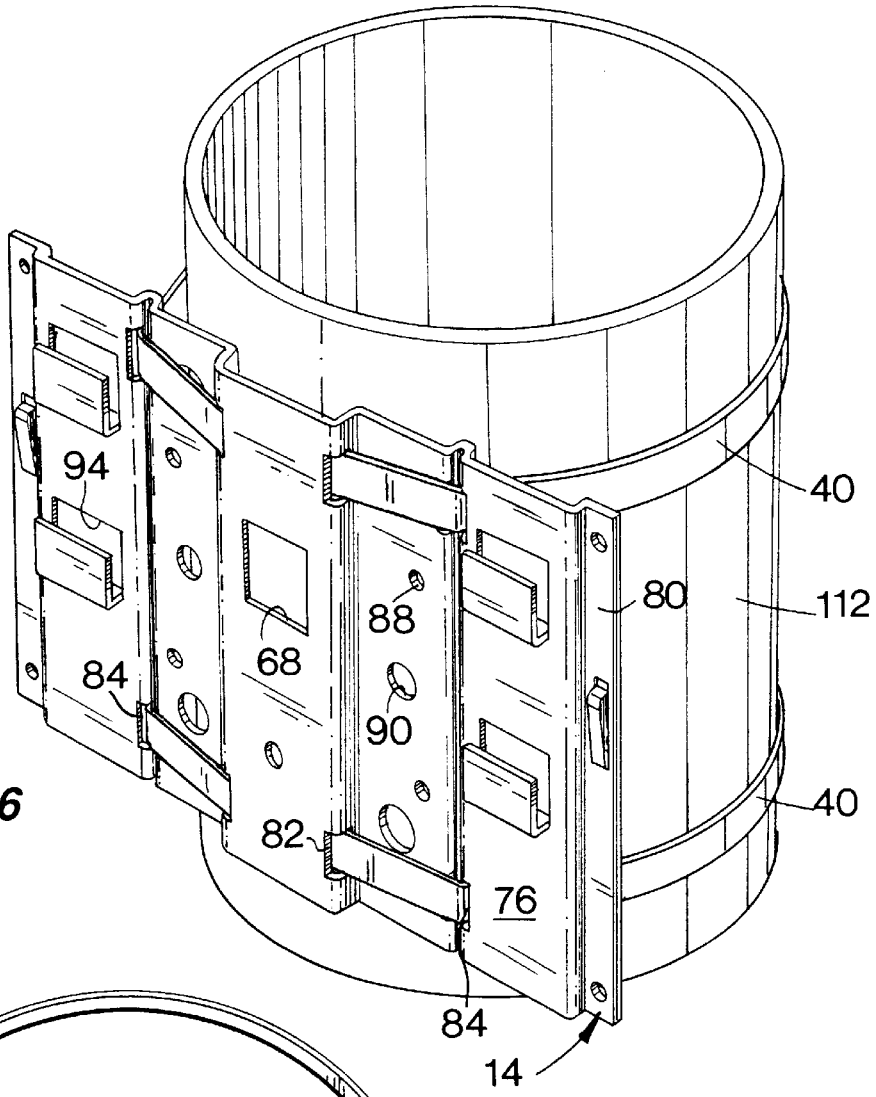
FIG. 16 is a perspective view illustrating the mounting of a plate devised according to the invention to a round post or piping having a diameter of approximately six inches utilizing strapping.
Figure 17:
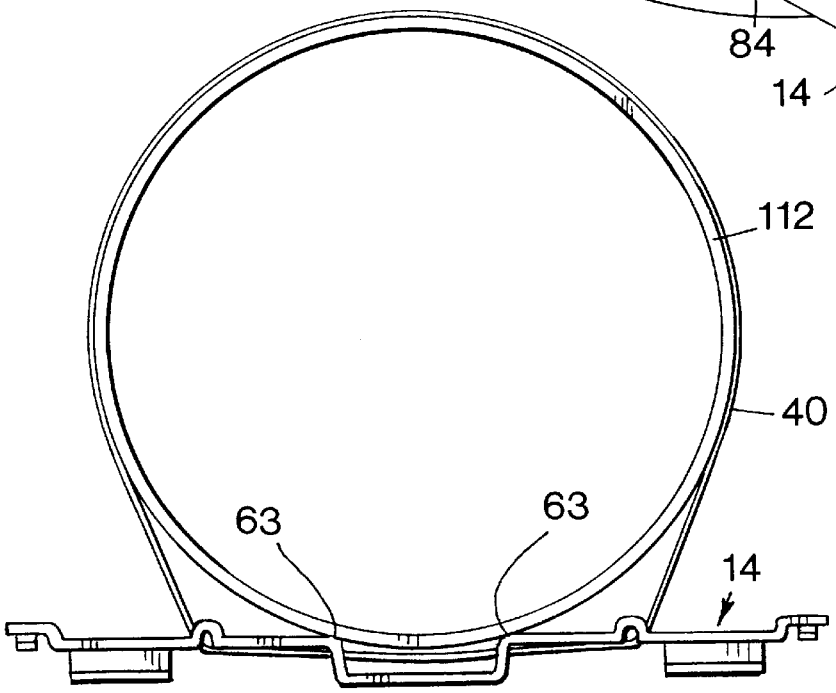
FIG. 17 is a top view taken from above the assembly of FIG. 16.

FIGS. 16 and 17 illustrate mounting of the mounting plate 14 to a post 112 by means of banding 40, the post 112 having a greater diameter than does the post 38 of FIGS. 12 and 13. The diameter of the post 112 in FIGS. 16 and 17 is taken to be approximately six inches, it being seen in FIG. 17 that the corners 63 continue to provide two points of contact, or two lines of contact, between said corners 63 and surfaces of the post 112. In larger diameter applications such as FIGS. 16 and 17, the more outwardly disposed slots 84 can be more conveniently used in order to further stabilize mounting of the plate 14 to the post 112.

Figure 18:
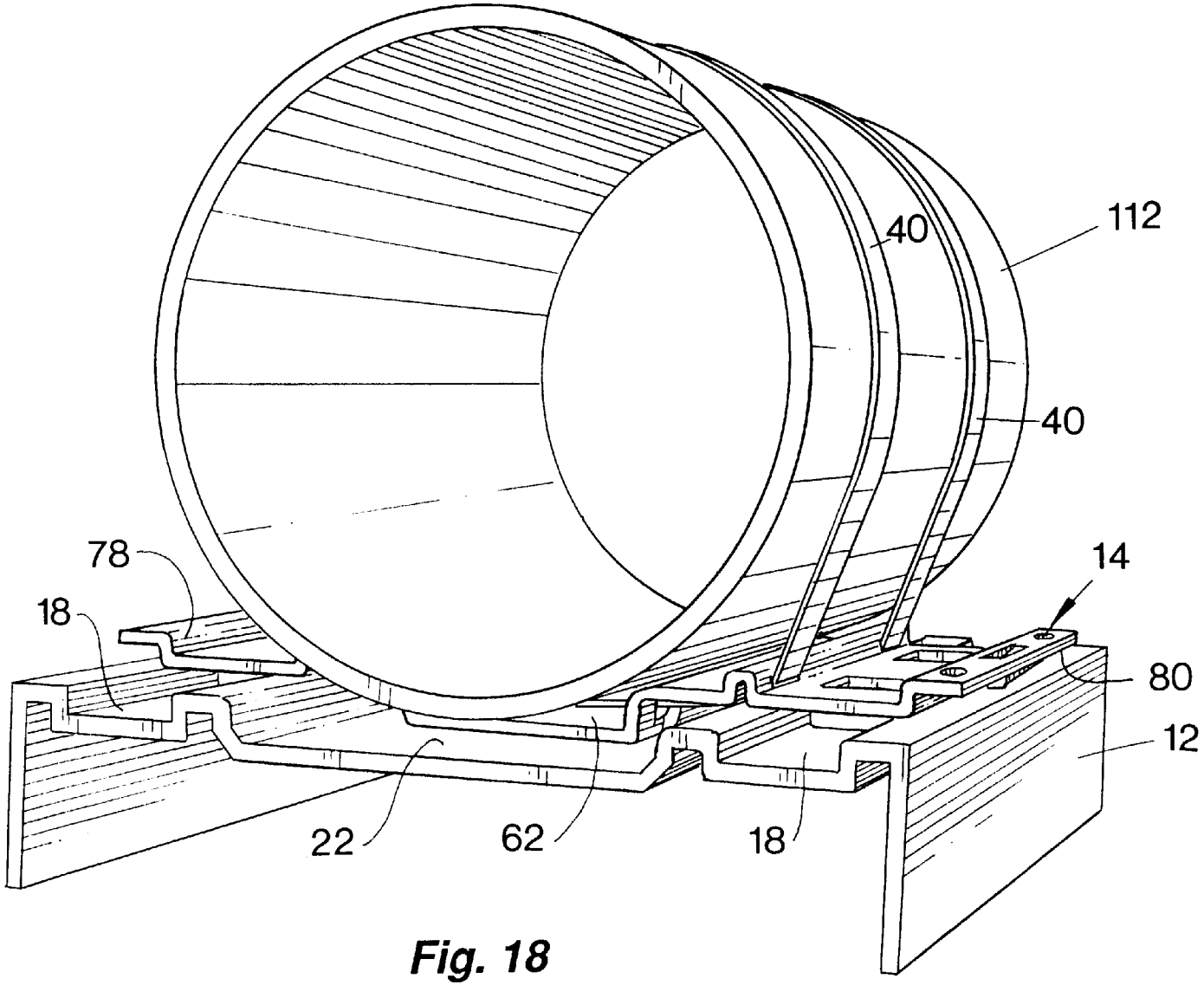
FIG. 18 is a perspective view illustrating the use of strapping to hold a mounting plate to a structural element by means of strapping and further mounting a lighting fixture, a portion of the housing of the lighting fixture being illustrated in the drawing.

On mounting of the mounting plate 14 to the post 112, it can be seen in FIG. 18, for example, that a lighting fixture can then be mounted to the mounting plate 14 as is seen in FIG. 18, only a portion of the housing 12 of the fixture being shown for simplicity. FIG. 18 further illustrates the typical intended use of two of the banding elements 40 in order to provide a more stable structure.

From the illustrations given, it is to be seen that poles smaller than three inches in diameter can be utilized with two points or lines of contact being retained. Further, diameters of four to six inches and larger are easily accommodated through use of the invention with two lines of contact being maintained between the mounting plate 14 and exterior surfaces of a large diameter pole, I-beam, square concrete pole, etc. Accommodation of round poles to approximately eight inches in diameter is particularly reasonable.

Referring again to the bayonet brackets 94 of the mounting plate 14, it is to be understood that a rib (not shown) or a pin can be provided lengthwise in said brackets 94 in the event that the brackets are not perfectly flat. Mounting of a lighting fixture to the mounting plate 14 is thus facilitated.

It is therefore to be seen that the mounting plate 14 can be mounted to normally available structure at necessary locations within an environmental space for mounting of luminaire fixtures and particularly emergency unit fixtures which must be mounted at particular locations and normally at positions elevated above a floor surface of the space preferably without the need for providing dedicated mounting structure for such fixtures. The mounting plate 14 of the invention is configured to cooperate with structure formed as a part of the housing of such fixtures so that the mounting plate 14 can be mounted in a desired location followed by mounting of the fixture to the mounting plate. While it is preferred to form the mounting plate 14 of the invention from a unitary piece of material such as metal or the like, it is possible to form said mounting plate 14 other than as an integral unit. Further, while it is preferable to form cooperating structure integrally with the housing of a fixture which is to be mounted by the mounting plate 14, it is within the scope of the invention to form such cooperating structure other than integrally while remaining within the intended scope of the invention. It is further intended according to the invention to provide structure on the mounting plate 14 capable of mounting to structure found within an environmental space other than that explicitly described herein. Accordingly, the scope of the invention is to be interpreted in light of the recitations provided by the appended claims.

What is claimed is:

1. A universal mounting plate mountable to a variety of incidental structures within an environmental space and to which a luminaire fixture can be rapidly and securely attached, the luminaire fixture having a housing which has at least one opening formed therein to receive at least one portion of the mounting plate thereinto for attachment of the fixture to the mounting plate, comprising:

a body member of generally plate-like conformation and comprised of a central U-shaped body portion, a substantially planar yoke portion of said body portion having at least one opening formed therein for fasteneing the mounting plate to the fixture;

means formed in portions of the body member for mounting of the body member to any one of a multiplicity of said variety of structures within an industrial space; and, means formed in portions of the body member for attachment of the body member to the luminaire fixture by means of receipt within the at least one opening formed in the housing of the fixture.

2. The mounting plate of claim 1 wherein the body member is further formed of lateral legs along edges of the yoke portion, slots being formed in the body portion at junctures of said yoke portion and legs in a pattern capable of receiving banding or strapping to facilitate mounting of the mounting plate to a pole or the like of differing diameter and cross-sectional shape.

3. The mounting plate of claim 5 wherein the lateral planar body portions are formed with apertures therein in patterns capable of mounting to structural framework, to junction boxes and the like and which are capable of pass-through of wiring into such junction boxes.

4. The mounting plate of claim 1 wherein the body portion has an opening formed therein, the fixture housing having a cooperating tab formed therein and receivable within the opening to snap-lock the mounting plate to the fixture housing.

5. The mounting plate of claim 1 and further comprising lateral planar body portions formed at edges of the U-shaped body portion, the lateral planar body portions lying in a common plane and being out of plane with the yoke portion of the U-shaped body portion.

6. The mounting plate of claim 5 wherein U-shaped ribs are formed along edges of the lateral planar body portions, the ribs having slots formed therein essentially at junctures thereof with the lateral planar body portions, the slots being in a pattern capable of receiving banding or strapping to facilitate mounting of the mounting plate to a pole, column, I-beam or the like of differing dimension and cross-sectional shape.

7. The mounting plate of claim 6 wherein yoke portions of the U-shaped ribs extend in a direction oppositely to the yoke portion of the central U-shaped body portion.

8. The mounting plate of claim 6 wherein outer planar body portions are formed along edges of the U-shaped ribs, the outer planar body portions being essentially coplanar with each other and with the plane in which the lateral planar body portions lie.

9. The mounting plate of claim 8 and further comprising means formed on the outer planar body portions of the mounting plate to comprise the attachment means of the body member received within the at least one opening of the fixture housing.

10. The mounting plate of claim 9 wherein the attachment means comprise at least one bayonet bracket element formed from a surface of the outer planar body portion, the bayonet bracket element being received and slidable into said opening in the fixture housing.

11. The mounting plate of claim 10 wherein the body portion has an opening formed therein, the fixture housing having a cooperating tab formed therein and receivable within the opening to snap-lock the mounting plate to the fixture housing on receipt of the bracket element into said opening formed in the housing.

12. The mounting plate of claim 10 wherein the plurality of openings are formed in a pattern in the fixture housing and a plurality of the bayonet bracket elements are formed on the mounting plate in a pattern whereby the bracket elements are each receivable and slidable into the openings to attach the fixture to the mounting plate.

13. The mounting plate of claim 12 wherein the body portion has an opening formed therein, the fixture housing having a cooperating tab formed therein and receivable within the opening to snap-lock the mounting plate to the fixture housing on receipt of the bracket elements into said openings formed in the housing.

14. The mounting plate of claim 10 wherein the body member is further formed of lateral flanges disposed one each along edges of each outer planar body portion, the lateral flanges each having means comprising a portion of the mounting means for facilitating mounting of the mounting plate to a surface such as a wall surface.

15. The mounting plate of claim 14 wherein the lateral flanges have openings formed therein comprising means for mounting the plate to a wall by receipt of fasteners therethrough.

16. The mounting plate of claim 14 wherein a portion of the mounting means temporarily mounts the mounting plate to said surface.

17. The mounting plate of claim 16 wherein the temporary mounting means comprise nailing stakes formed from surfaces of the lateral flanges and having end portions shaped to facilitate mounting of the stakes to a wall surface or the like to temporarily mount the mounting plate to said wall surface.

* * * * *